United States Patent [19]

Freeberg

[11] Patent Number: 5,026,062

[45] **Date of Patent: * Jun. 25, 1991**

[54] GOLF PUTTER WITH ALIGNMENT DEVICE

[76] Inventor: Lloyd L. Freeberg, 1953 E. Chapman Ave., Fullerton, Calif. 92631

[ * ] Notice: The portion of the term of this patent, subsequent to Jun. 12, 2007 has been disclaimed.

[21] Appl. No.: 519,890

[22] Filed: May 7, 1990

Related U.S. Application Data

[63] Continuation-in-part of Ser. No. 177,134, Apr. 4, 1988, Pat. No. 4,932,659.

[51] Int. Cl.[5] ..... A63B 69/36

[52] U.S. Cl. ..... 273/183 D; 273/164; 273/81.4; 273/81 B; 273/168

[58] Field of Search ..... 273/183 D, 168, 163 R, 273/163 A, 164, 81.4, 81 B, 186 A, 193 R, 194 R; D21/219

[56] References Cited

U.S. PATENT DOCUMENTS

| | | | |
|---|---|---|---|
| 4,327,916 | 5/1982 | Shiratori | 273/183 D |
| 4,537,403 | 8/1985 | Farina | 273/168 |
| 4,569,525 | 2/1986 | Folger | 273/81 B |
| 4,932,659 | 6/1990 | Freeberg | 273/183 D |

*Primary Examiner*—George J. Marlo

*Attorney, Agent, or Firm*—Plante Strauss Vanderburgh and Connors

[57] ABSTRACT

There is disclosed a golf putter having a unique shape that improves putting performance. The putter has a more or less conventional head with a flat, ball-striking surface. The shaft of the putter has a rectangular cross section and is formed of a visibly opaque material. A highly visible marker is located on the shaft band to be shielded from the player's view by the shaft when the club is properly oriented, and visible to the player when the club head is open or closed, thereby indicating to the user whether the putter face is open, closed, or properly aligned. The shaft can be tapered and is rectangular in cross section and terminates with a handle which is also rectangular in cross section. The preferred putter has front surfaces for the handle, shaft and putter face which are parallel. Most preferably, the rear surfaces of the handle, shaft and putter face are also parallel and, most preferably, are also co-planar, thereby permitting reversal of the putter between left and right handed players. In the preferred embodiment, the surfaces of the handle are flush with the mating surfaces of the shaft and both of the front and rear surfaces of the handle have a highly visible band to indicate to the user whether the putter face is open, closed, or properly aligned.

14 Claims, 3 Drawing Sheets

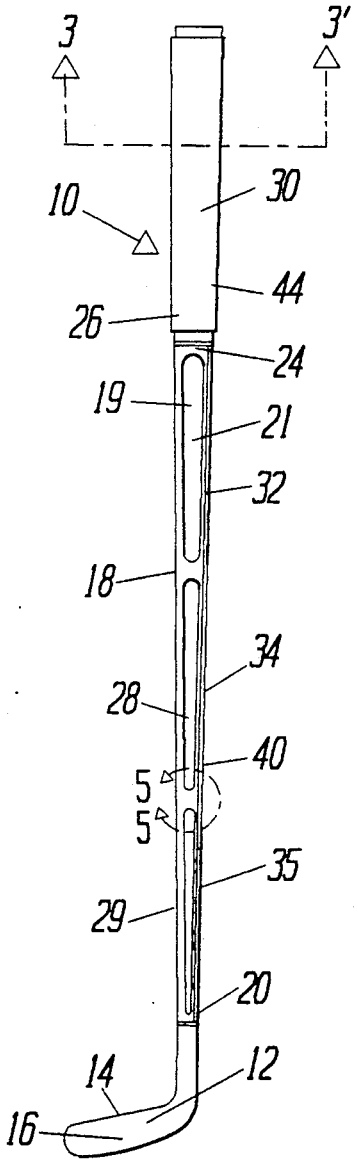
FIGURE 1
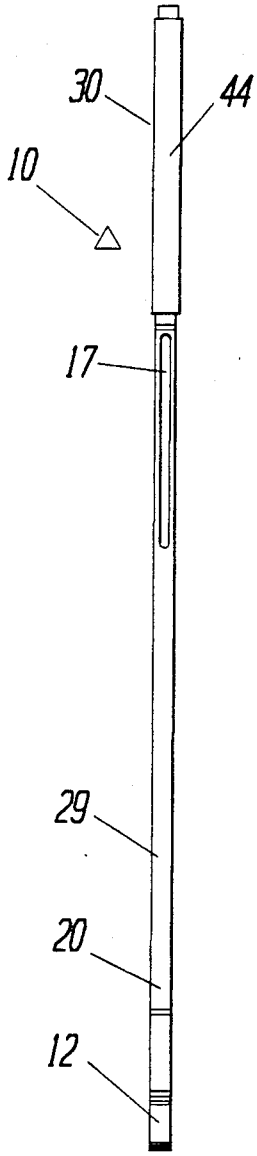
FIGURE 2
FIGURE 3
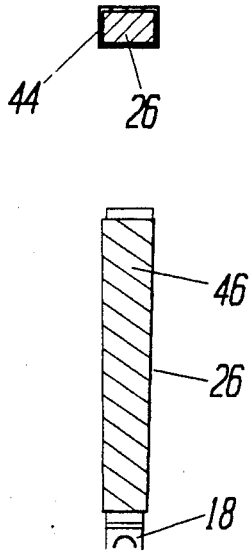
FIGURE 4
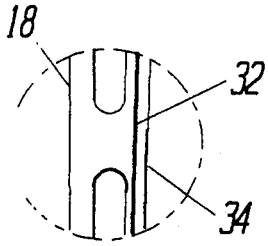
FIGURE 5

FIGURE 6
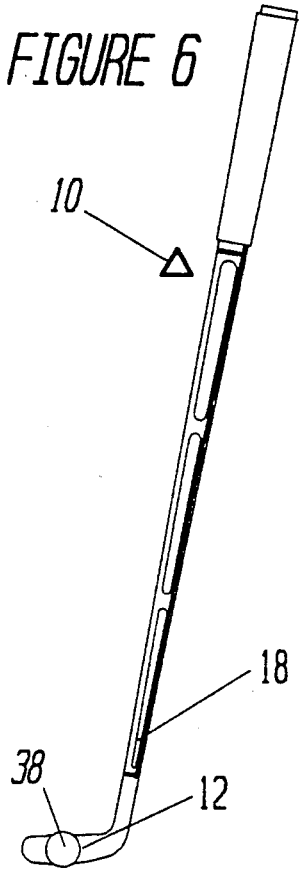
FIGURE 10
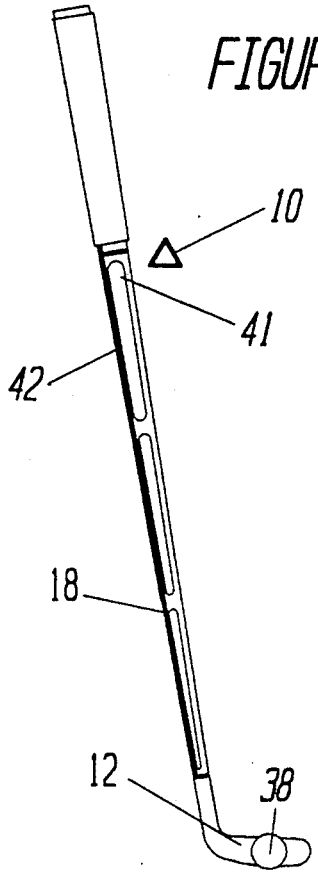
FIGURE 7
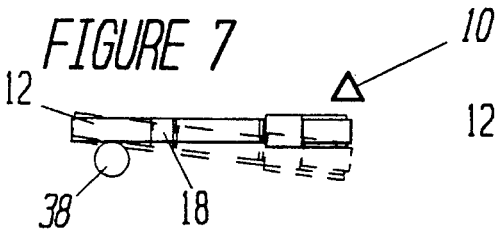
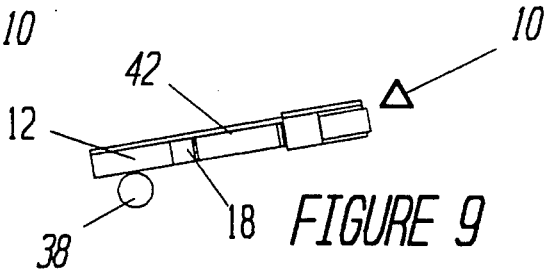
FIGURE 9
FIGURE 8
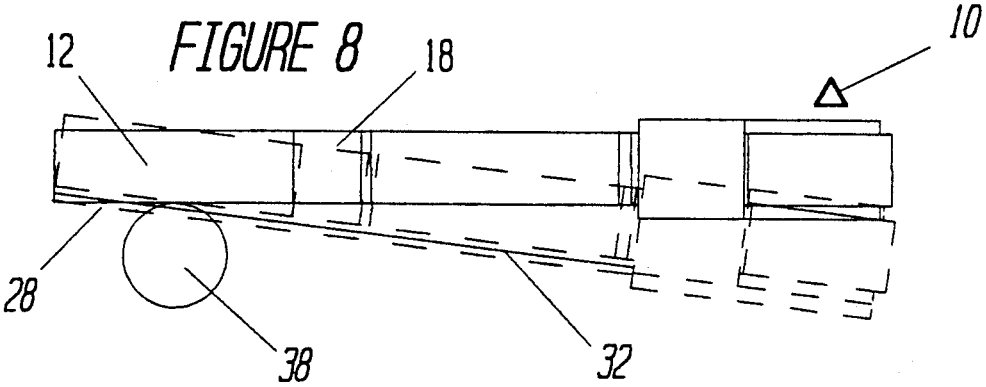

GOLF PUTTER WITH ALIGNMENT DEVICE

REFERENCE TO RELATED APPLICATIONS

This application is a continuation-in-part of my copending application Ser. No. 177,134 filed Apr. 4, 1988 now U.S. Pat. No. 4,932,659.

BACKGROUND OF THE INVENTION

1. Field of Invention

This invention relates to a golf putter and, in particular, to a golf putter having a design which gives improved performance.

2. Brief Statement of the Prior Art

Many attempts have been made to design clubs and handles for golf which will improve performance. U.S. Pat. No. 4,569,525 shows a training accessory for mounting on the shaft of a golf club to indicate to a player when the face is open or closed, thereby providing informational feedback to the player which will cause the player to correct the rotation of the player's wrists.

U.S. Pat. No. 4,537,403 discloses a putter having a flat, narrow shaft which is intended to minimize obstructions when viewing the club head.

U.S. Pat. No. 4,629,191 discloses a golf club having a pentagonal cross section with multiple sides.

U.S. Pat. No. 3,109,653 discloses a hand grip for a golf putter having an unusual contour to the hand grip portion. Additionally, prior art pertaining to other sports such as hockey discloses sticks which customarily are flat and planar such as shown in U.S. Pat. No. 2,957,208.

U.S. Pat. No. 4,327,916 discloses a putter which is provided with a transparent shaft. The shaft has a guide line scribed on the transparent shaft, and the user sights through the transparent shaft and checks the alignment of the blades of grass with the guide line.

BRIEF STATEMENT OF THE INVENTION

This invention comprises a golf putter having a unique shape that improves putting performance. The putter has a more or less conventional head with a flat, ball-striking surface and a shaft having a rectangular cross section. The front and rear surfaces of the shaft have a highly visible band to indicate to the user when the putter face is open, closed, or properly aligned. Preferably the shaft is tapered, with its narrowest end adjacent the putter head and its widest portion at the handle. The shaft is rectangular in cross section and terminates with a handle which is also rectangular in cross section. In the preferred embodiment, the front surfaces of the handle, shaft and putter face are parallel, and most preferably, are co-planar. Preferably the reverse sides are parallel, and most preferably are also co-planar, thereby permitting reversal of the putter between left and right handed players. In the preferred embodiment, the surfaces of the handle are flush with the mating surfaces of the shaft, however, the handle can receive a covering to improve its surface for gripping. The shaft and handle can be formed a single, unitary member, preferably by molding operations, and can be formed of metal or fiber reinforced plastic.

BRIEF DESCRIPTION OF THE DRAWINGS

The invention will be described with reference to the FIGURES of which:

FIG. 1 is a front elevational view of the putter of the invention;

FIG. 2 is a side elevational view of the putter;

FIG. 3 is a view along lines 3-3' of FIG. 1; illustrating the hand grip surface;

FIG. 4 illustrates an alternative hand grip surface;

FIG. 5 is an enlarged view of the area within line 5-5' of FIG. 1;

FIG. 6 is a view of the putter of the invention aligned with a golf ball;

FIG. 7 is a top view of the putter and ball shown in FIG. 6;

FIG. 8 is an enlargement of FIG. 7;

FIG. 9 is a top view of the putter and ball of FIG. 6 with the putter face improperly open;

FIG. 10 is a view of the putter aligned with a golf ball for a player opposite-handed from the alignment of FIG. 6.

DESCRIPTION OF PREFERRED EMBODIMENT

Figure 11:
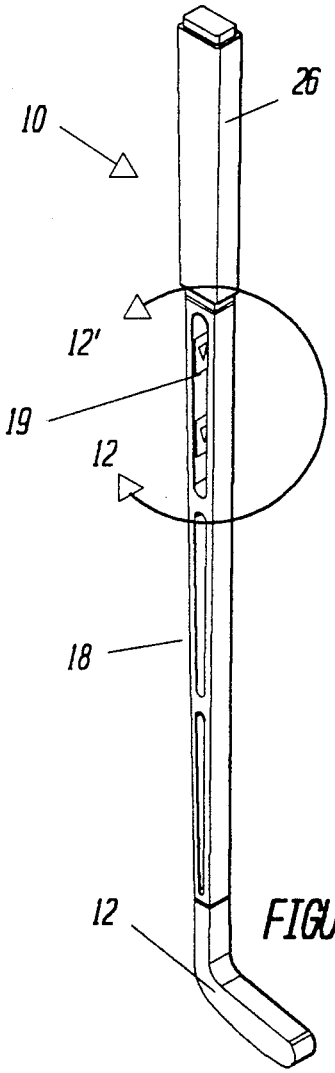
FIG. 11 is a perspective view of an alternative embodiment.

Referring now to FIG. 1, the putter 10 of this invention is illustrated in elevational view. The putter 10 includes a head 12 of more or less conventional construction and the head 12 has a rectangular shaped body 14 having a ball-striking face 16. The head 14 is solid form and, in some applications, one or more weights (not shown) can be added along the base and at the "sweet spot" of the putter head 12 to improve its performance.

Figure 12:
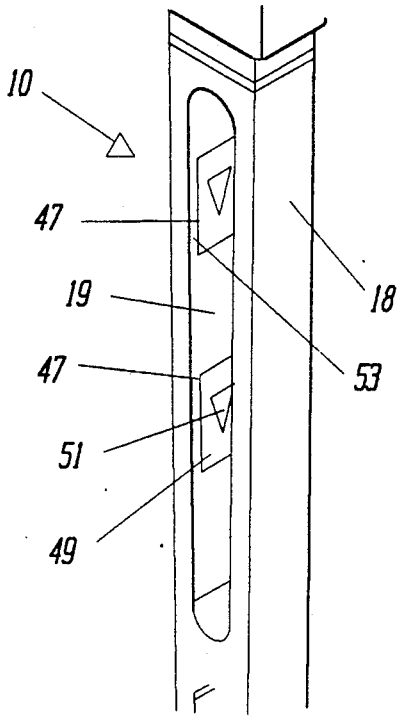
FIG. 12 is an enlarged view of the area within line 12-12' of FIG. 11.

The head is fixedly secured to the end of a shaft 18 which is rectangular in cross section. The shaft can have one or more slots 19 along its length, and these slots can extend entirely through the shaft, to reduce its weight. A thin web 21 can be provided along the midline of the shaft to reduce the tendency of the shaft to resonant or vibrate when the putter strikes a ball. Alternatively, and as shown in FIGS. 11 and 12, the slots 19 can be entirely open without web 21.

The shaft 18 is preferably tapered, with its narrowest end 20 adjacent the putter head 12, terminating in a flush attachment to the ball-striking surface 16 of the head 12. In the preferred embodiment, the shaft 18 is molded and the club head 12 is integral therewith. The widest end 24 of the tapered shaft 18 is adjacent the handle 26. The forward face 28 of the shaft 18 is parallel to the forward face 30 of the rectangular handle 26 and, preferably, these surfaces are coplanar.

The forward face 28 of the shaft 18 has a visible band 32 which extends coextensively its length and which is of a highly visible material. This band can be best seen in FIG. 5. The band can be provided by masking or painting a stripe along at least the lower edge 34 of the forward face 28. In some applications, the entire forward face of the shaft 18 can be covered with the highly visible band. Alternatively, a colorful, adhesively backed tape can be laid along the forward, lower edge 34 of the forward face 28 of the shaft 18.

Preferably a shallow groove 17 is provided on the rear surface 40 of handle 18; see FIG. 2. This groove provides a surface for placement of an identifying decal.

Referring now to FIGS. 6 and 7, the putter 10 is shown in alignment with a ball 38. The correct alignment is shown in solid lines in FIG. 7, and in an incorrect, closed alignment in phantom lines. As more evident in the enlarged view of FIG. 8, the band 32 provides a visible indication to the player of misalignment of the putter face 28 when the ball is addressed and also during the stroke of the club. When the ball 38 is correctly addressed in the manner illustrated in the solid lines of FIG. 8, the band 32 is invisible to the player. If the band is visible to the player and the club is in a position as illustrated in the phantom lines of FIG. 8, then the player will recognize that the club face is open and the ball is improperly addressed.

The opposite surface 41 of the shaft 18 also has a similar visible band 42; see FIG. 10. As shown in FIG. 9, when the club head 12 is closed to the ball 38, the rear band 42 will become visible to the player, again indicating an improper addressing of the ball, and requiring correction of the player's wrist and hands.

An alternative embodiment is shown in FIGS. 11 and 12. As there illustrated, the slots 19 extend entirely through the handle 18. The club is substantially similar to that shown in FIGS. 1–10, and has a handle 28 on shaft 19 with a solid form club head 12. As apparent from FIG. 12, however, this embodiment has one or more markers 47 which are located along the rear inside surface 45 of slot 19. The markers are preferably rectangular with side edges which are immediately adjacent and parallel to the front and rear faces of the shaft. Two such markers are shown in FIG. 12. Each marker has a generally rectangular field 49 which is colored or textured to provide a high visibility. For this purpose, a very bright red or orange tape can be used. Located in the center of each marker can be a pointer 51 which is aligned with the centerline of the shaft.

Figure 13:
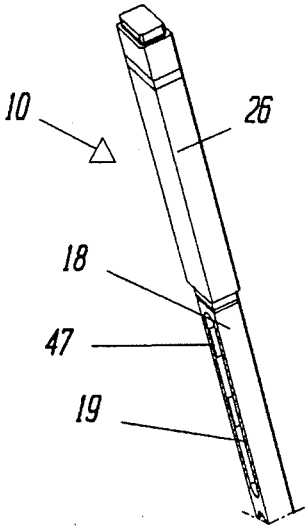
FIG. 13 illustrates the use of the markers of the embodiment of FIGS. 11 and 12.

As shown in FIG. 13, the marker 47 serves the same purpose as the visible band 32 of the previously described embodiment. When the club head is properly addressed to the ball, the marker 47 is invisible to the player, being covered by the shaft 18. If the club head is open or closed, however, as shown in FIG. 13, the shaft is rotated sufficiently to expose the marker 47 to the view of the player, alerting the player of the misalignment of the club head. Preferably, the field 49 is slightly lesser in width than the club shaft 18, thereby providing a slight margin 53 on its opposite sides. This corrects for any parallax and insures precise orientation of the club head.

Referring again to FIG. 1, the handle 26 can be provided with a improved surface for gripping, such as the flexible and elastic cover 44 illustrated in FIGS. 1 and 3. Alternatively, the handle surfaces can be wrapped or covered with a suitable resilient tape 46 formed of plastic or rubber which is adhesively bonded to the handle in a suitable wrapping such as the spiral wrap illustrated in FIG. 4.

The most preferred embodiment employs a handle 26 and a connecting shaft 18 which have coplanar forward faces which are also coplanar with the ball striking face 16 of the putter head 12. This is illustrated in FIGS. 1 and 2, in which the top surface 29 and the bottom surface 35 of the shaft are tapered or inclined towards each other along surfaces which are orthogonal to the front face 28 and rear face 40. This taper in the shaft 18 is optional, and can be used to provide a feeling of strength and rigidity to the shaft without conveying a feeling of excess mass and without rendering the putter too cumbersome for continuous play. Since the forward faces 28 and 30 of the shaft and handle, respectively, are coplanar with the ball striking face 16 of the head 12, the highly visible bands 32 and 42 provide a constant indication of the alignment of the head to the ball, and perfect alignment can easily be obtained.

Preferably, the body of the shaft is relieved by the aforementioned slots 19 which extend, from each side, into the shaft. The slots can be entirely open, or can be closed with a thin web 21. As previously mentioned, this reduces the bulk or weight of the putter without causing resonance or vibration.

As shown in FIGS. 1 and 2, the handle and shaft are formed as a single molded, integral member in which the surfaces of the handle are co-planar with the surfaces of the shaft, and the shaft extrusion is tapered, all as shown in FIG. 1. The handle will appear to be of slightly greater thickness and width as it is received within the aforementioned resilient covering, thereby slightly increasing its dimensions.

As previously mentioned, the highly visible bands on the forward and rear faces of the shaft, or the markers on the rear inside surfaces of slots in the shaft, provide a visual indication to the player that the club face is improperly open or closed when the ball is addressed, indicating to the player that the player's wrists should be rotated more or a new grip should be taken of the club which will close the face of the club and render the bands invisible to the player.

The shaft is formed of an optically opaque material, i.e., the shaft cannot be transparent, as it must function to shield the player's view of the band 32 when the putter is in the proper orientation, as described hereinafter. Suitable materials for the shaft and club head include metals such as stainless steel, aluminum, magnesium, or aluminum or magnesium alloys. Other suitable materials include fiber reinforced plastics, e.g., carbon or graphite fiber reinforced plastics, preferably thermoplastics, e.g., polystyrene. Thermosetting plastics such as polyurethanes, epoxy resins, etc., can also be used.

Preferably, the shaft and handle are integral and formed of the same material. This construction provides for minimal expense while preserving the integrity of the handle and shaft and insuring that the critical surfaces of these elements are either co-planar or entirely flush thereby providing for maximum accuracy of putting with the club. The visible bands can be provided on the forward and rearward faces of the shaft by any of a variety of means. A preferred material for the bands and markers is colored and reflective Mylar tape sufficiently bright or iridescent to ensure that the player's attention will be directed to any misalignment of the putter. Alternatively, and particularly when extruded aluminum and aluminum alloys are used for the shaft, the band can be permanently provided on the shaft by anodized coatings and the like.

The putter has been found to provide a remarkable increase in accuracy when used by weekend golfers and by professionals. Since the putter is symmetrical from side-to-side it can be used by right or left hand players, and a player can freely switch from left to right hand putting without changing the putter. The single continuous plane through the putter face, shaft and handle insures precise alignment with the ball. The player can also easily see whether the face of the putter is open or closed by observing the colored bands on its front and rear surfaces of the shaft, and make a compensating adjustment.

Players readily adapt to the feel and characteristics of the putter and within a short time of practice achieve significant improvements in putting accuracy. The rectangular flat-sided grip minimizes muscle tension, and aids in accuracy as it reduces the tendency for the player to tense up or choke during a stroke. The known principles of physiology indicate that when a player grips a round shaft or grip, the "wrapping" of the hands around such a shaft creates muscle tension in the wrists, arms, and shoulders. This muscle tension, in turn, causes rotation off-line of the putter head both at address, and throughout the stroke. The rectangular shaft described promotes an opposing palms grip which prevents the tendency to rotate the putter head.

The putter meets all of the requirements of the applicable rules of the golfing associations, and is thus entirely acceptable for regulation and tournament play.

The invention has been described with reference to the illustrated and presently preferred embodiment. It is not intended that the invention be unduly limited by this disclosure of the presently preferred embodiment. Instead, it is intended that the invention be defined, by the means, and their obvious equivalents, set forth in the following claims:

What is claimed is:

1. A golf putter including:
   a. a head having a flat ball-striking face;
   b. a handle with a hand grip having a rectangular cross section;
   c. an optically opaque shaft extending between said head and handle with a tapered rectangular cross section having a flat, front surface parallel to said ball-striking face with its narrowest end adjacent said head and widest end adjacent said handle; and
   d. at least one visible marker carried on said shaft at a location which is shielded by said shaft from view of the user of the putter when properly held, and exposed to said view when the club face is open or closed.

2. The golf putter of claim 1 wherein said visible marker comprises a highly visible band coextensive the length of said shaft and located along said front surface of said shaft.

3. The golf putter of claim 1 wherein the front and rear said hand grip surfaces are substantially coplanar with respective surfaces of said shaft.

4. The golf putter of claim 1 wherein said front and rear surfaces hand grip of said handle are flush with the respective front and rear surfaces of said shaft.

5. The golf putter of claim 1 wherein the forward facing side of said shaft is coplanar with said flat ball-striking face of said head.

6. The golf putter of claim 1 wherein the front and rear surfaces of said shaft which are parallel to said ball-striking face are greater in width than the surfaces which are normal to said ball-striking face.

7. The golf putter of claim 1 wherein said hand grip with a resilient flexible covering.

8. A golf putter including:
   a. a head having a flat ball-striking face;
   b. a handle with a hand grip having a rectangular cross section;
   c. an optically opaque shaft extending between said head and handle with a tapered rectangular cross section having a flat, front surface parallel to said ball-striking face with its narrowest end adjacent said head and widest end adjacent said handle;
   d. at least one longitudinal through slot in said handle having an inside rear wall;
   e. a highly visible patch located on said inside rear wall of said slot at a location which is shielded by said shaft from view of the user of the putter when properly held, and exposed to said view when the club face is open or closed.

9. The golf putter of claim 8 wherein said patch has side edges adjacent and parallel to the side edges of said slot.

10. The golf putter of claim 8 including a pointer indicum on said patch and located on the mid-line of said shaft.

11. The golf putter of claim 8 wherein said front and rear surfaces hand grip of said handle are flush with the respective front and rear surfaces of said shaft.

12. The golf putter of claim 8 wherein the forward facing side of said shaft is coplanar with said flat ball-striking face of said head.

13. The golf putter of claim 8 wherein the front and rear surfaces of said shaft which are parallel to said ball-striking face are greater in width than the surfaces which are normal to said ball-striking face.

14. The golf putter of claim 8 wherein said hand grip is covered with a resilient flexible covering.

* * * * *

UNITED STATES PATENT AND TRADEMARK OFFICE

CERTIFICATE OF CORRECTION

PATENT NO. : 5,026,062

DATED : June 25, 1991

INVENTOR(S) : Lloyd L. Freeberg

It is certified that error appears in the above-identified patent and that said Letters Patent is hereby corrected as shown below:

Claim 7, column 6, line 12, before "with" insert

--is covered--

Signed and Sealed this

Third Day of November, 1992

*Attest:*

DOUGLAS B. COMER

*Attesting Officer*

*Acting Commissioner of Patents and Trademarks*